US011085698B2

(12) United States Patent
Nakamura

(10) Patent No.: US 11,085,698 B2
(45) Date of Patent: Aug. 10, 2021

(54) HEATING FURNACE

(71) Applicant: NGK INSULATORS, LTD., Nagoya (JP)

(72) Inventor: Tomoo Nakamura, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 123 days.

(21) Appl. No.: 16/290,027

(22) Filed: Mar. 1, 2019

(65) Prior Publication Data

US 2019/0301801 A1 Oct. 3, 2019

(30) Foreign Application Priority Data

Mar. 28, 2018 (JP) ..... JP2018-063051

(51) Int. Cl.

| | |
|---|---|
| ***F27D 1/00*** | (2006.01) |
| ***F27B 17/00*** | (2006.01) |
| ***F27B 9/36*** | (2006.01) |
| ***F27B 7/34*** | (2006.01) |

(52) U.S. Cl.

CPC ..... *F27B 17/0016* (2013.01); *F27B 7/34* (2013.01); *F27B 9/36* (2013.01)

(58) Field of Classification Search

CPC .... F27D 1/00; F27D 1/003; F27D 2001/0059; F27B 2014/0104; F27B 1/00; F27B 17/0016; F27B 9/34; F27B 9/36

See application file for complete search history.

(56) References Cited

U.S. PATENT DOCUMENTS

| | | | | |
|---|---|---|---|---|
| 3,718,323 | A | 2/1973 | Ulbrich | |
| 4,740,406 | A | 4/1988 | Narumiya et al. | |
| 5,725,829 | A * | 3/1998 | Miyahara | F27B 9/3011 264/630 |
| 6,669,751 | B1 * | 12/2003 | Ohno | B01D 46/247 55/523 |
| 7,112,233 | B2 * | 9/2006 | Ohno | B01D 46/2466 55/523 |
| 7,335,019 | B2 * | 2/2008 | Suzuki | C04B 38/0006 264/683 |
| 7,491,057 | B2 * | 2/2009 | Saijo | F27D 1/14 432/206 |

(Continued)

FOREIGN PATENT DOCUMENTS

| | | |
|---|---|---|
| DE | 2 204 058 A | 8/1972 |
| DE | 36 07 047 C2 | 5/1994 |

(Continued)

OTHER PUBLICATIONS

Haimo Schaumburg (Editor), "Keramik," *Werkstoffe and Bauelemente der Elektrotechnik*, vol. 5, 1994, p. 15.

(Continued)

*Primary Examiner* — Gregory A Wilson
(74) *Attorney, Agent, or Firm* — Burr & Brown, PLLC

(57) ABSTRACT

A heating furnace comprising a furnace body; an accommodation space in the furnace body, the accommodation space accommodating a work; an exhaust port; and a heat insulator provided between the accommodation space and the exhaust port, the heat insulator including a pillar-shaped honeycomb structure including ceramic partition walls sectioning a plurality of cells extending from one bottom to another bottom.

10 Claims, 6 Drawing Sheets

(56) References Cited

U.S. PATENT DOCUMENTS

| | | | | |
|---|---|---|---|---|
| 7,947,386 | B2 * | 5/2011 | Chung | H01M 8/2425 429/447 |
| 8,658,103 | B2 * | 2/2014 | Mutsuda | F01N 3/2853 422/179 |
| 2006/0029898 | A1 * | 2/2006 | Saijo | F27B 9/067 432/247 |
| 2011/0127699 | A1 * | 6/2011 | Vayansky | C04B 38/0006 264/630 |

FOREIGN PATENT DOCUMENTS

| | | | | |
|---|---|---|---|---|
| JP | 2008120653 | A | * | 5/2008 |
| JP | 2008-261619 | A1 | | 10/2008 |
| JP | 2012021742 | A | * | 2/2012 |
| JP | 5989357 | B2 | | 9/2016 |

OTHER PUBLICATIONS

German Office Action (Application No. 10 2019 002 000.6) dated Dec. 3, 2019 (with English translation).

* cited by examiner

[FIG. 1]
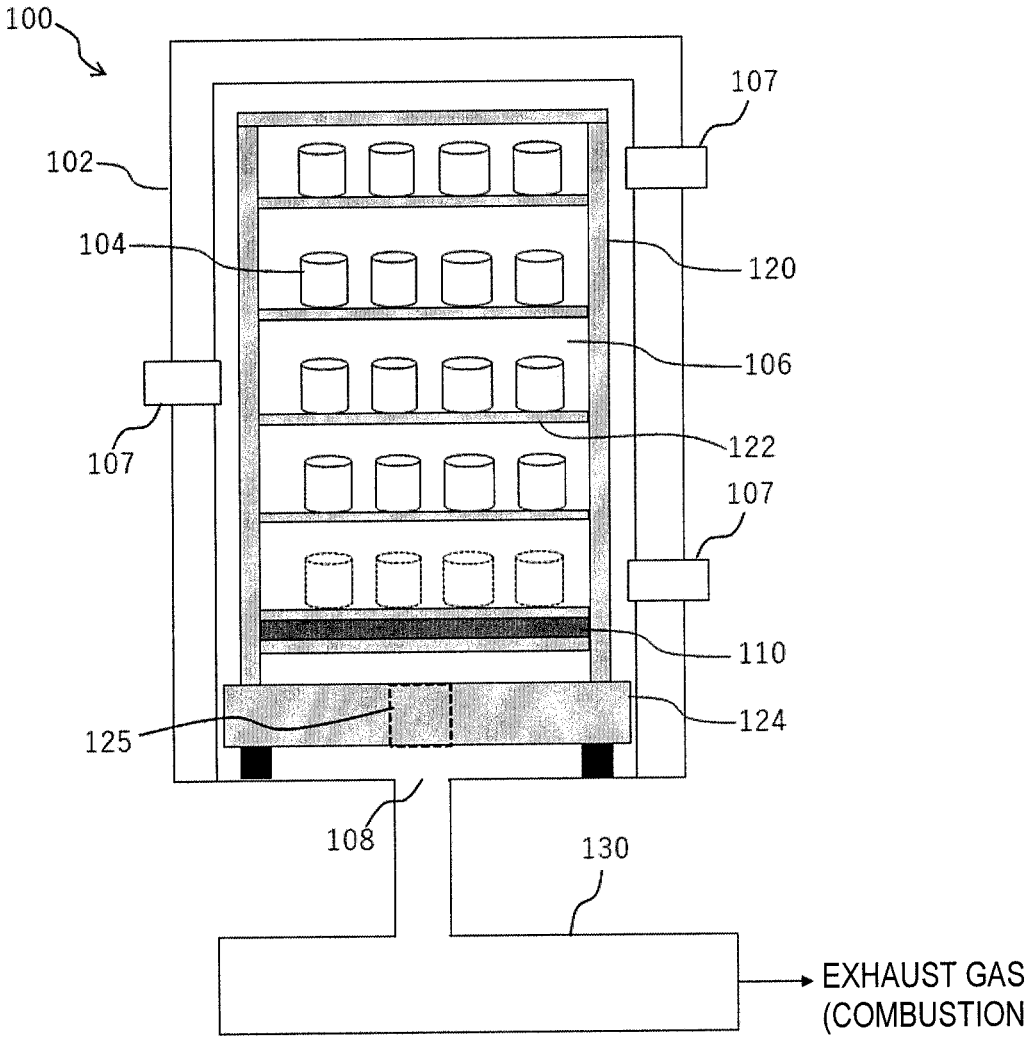

[FIG. 2]
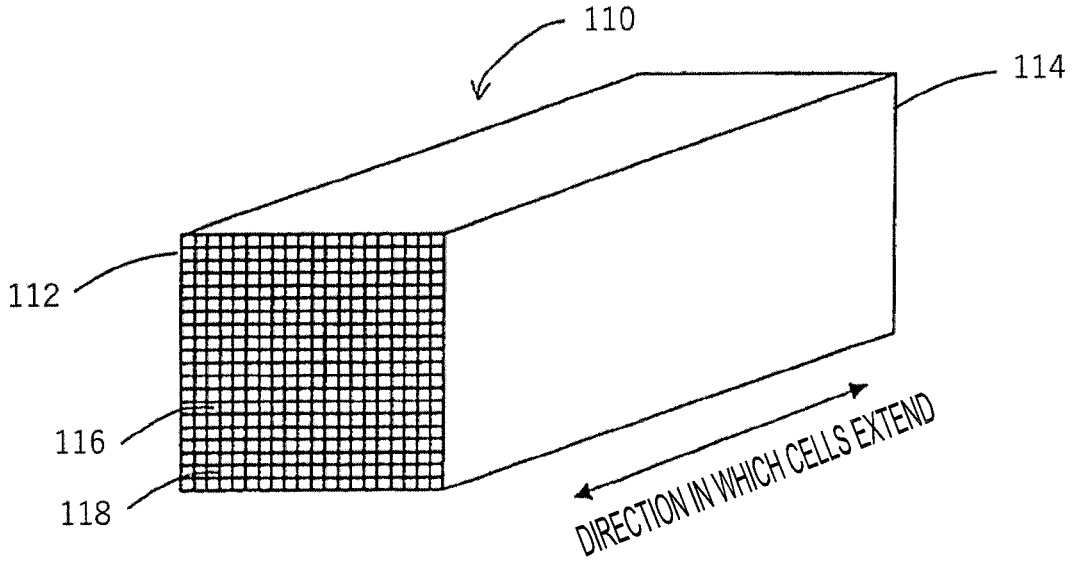
[FIG. 3]
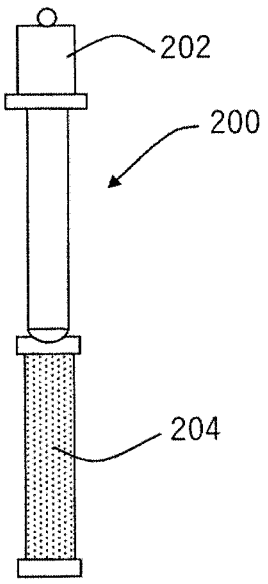

[FIG. 4]
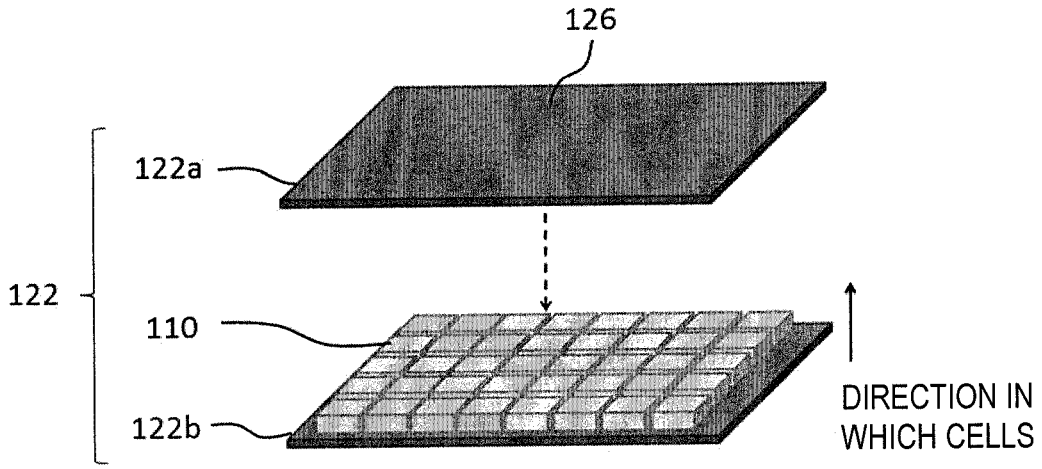
[FIG. 5]
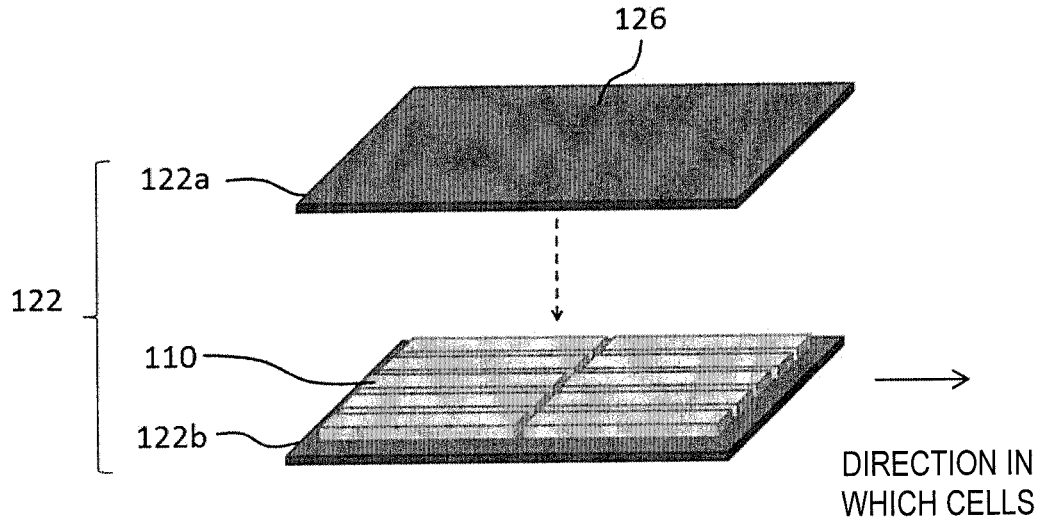

[FIG. 6]
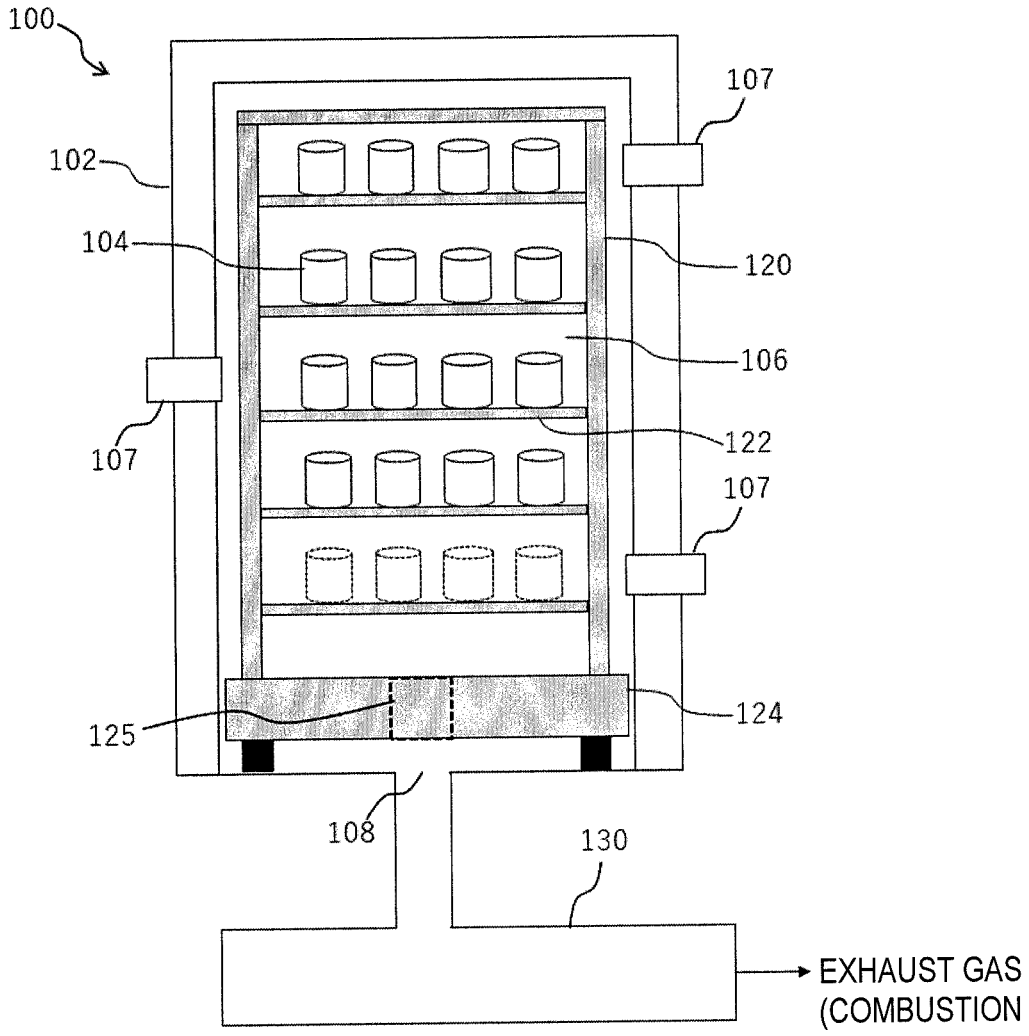

[FIG. 7]
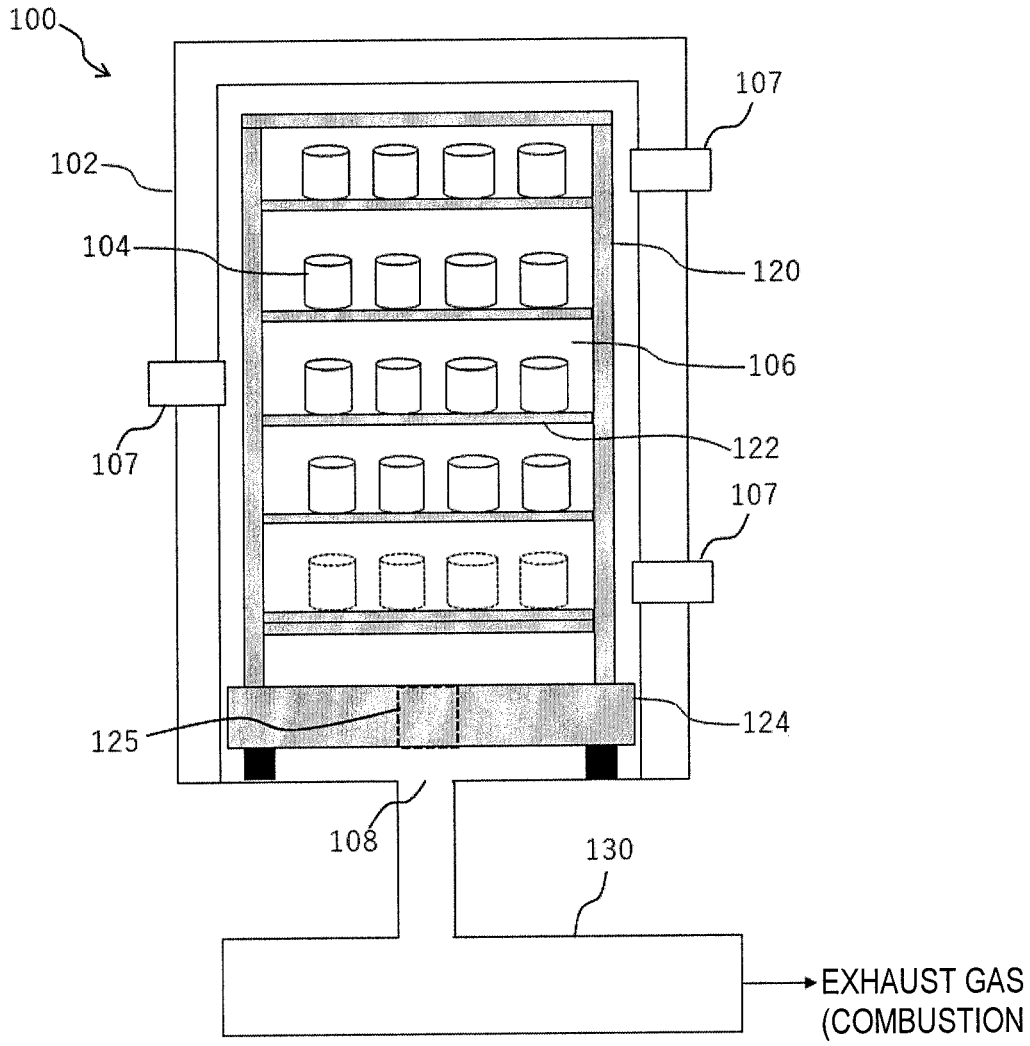

[FIG. 8]
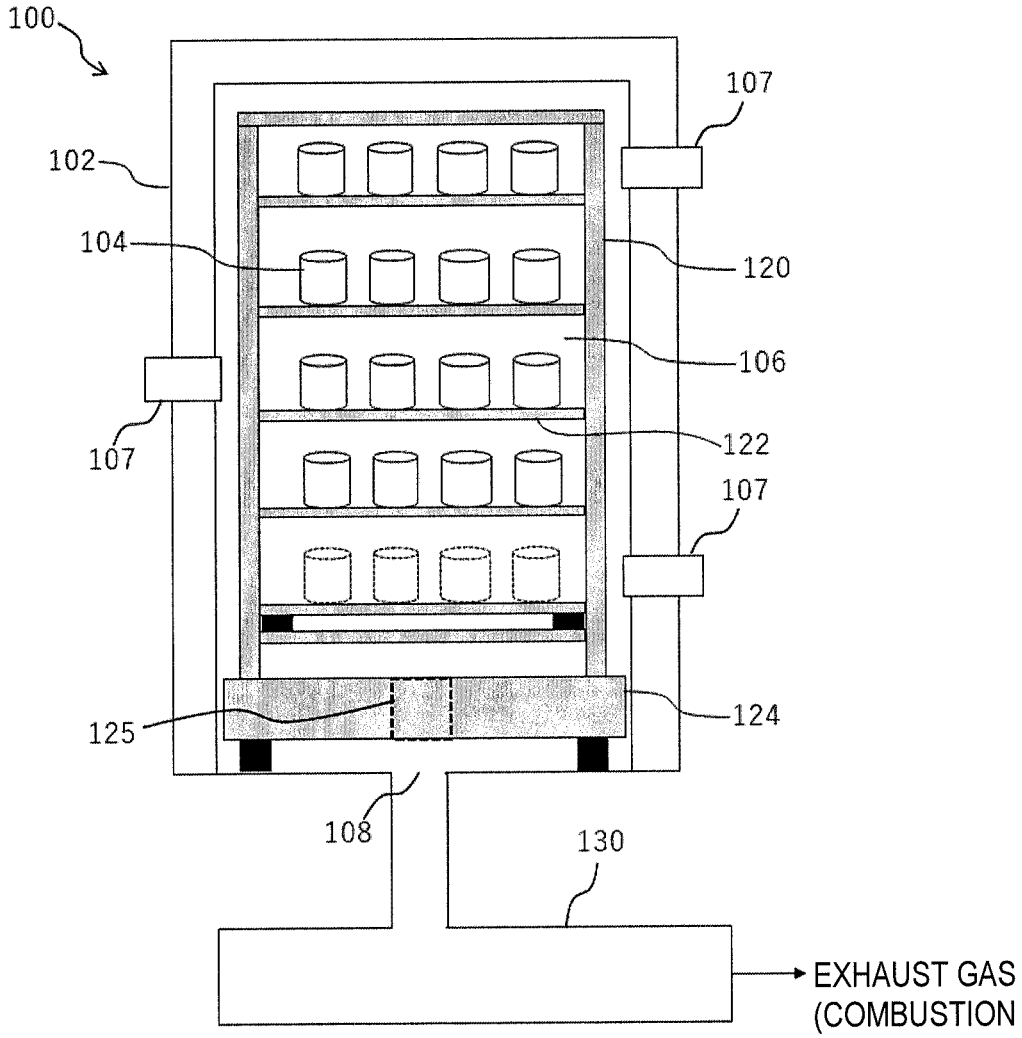

HEATING FURNACE

This application claims the benefit under 35 USC § 119(a)-(d) of Japanese Application No. 2018-063051 filed Mar. 28, 2018, the entirety of which is incorporated herein by reference.

FIELD OF THE INVENTION

The present invention relates to a heating furnace. The present invention particularly relates to a heating furnace that can be used in ceramic mass-production processes.

BACKGROUND OF THE INVENTION

During the manufacturing of various products, a heating furnace is used for heat treatment in some cases. For example, for the manufacturing of a ceramic product, a process is widely used in which ceramic raw material powder is first formed into a desired shape to fabricate a formed body, the formed body is introduced into a heating furnace, and the ambient temperature in the heating furnace is increased to a high temperature, thereby firing the formed body.

During heat treatment, it is often required that the ambient temperature in the heating furnace is uniform regardless of the location, for ensuring stable product quality. To meet this requirement, a technique has been proposed for uniformizing the ambient temperature in the heating furnace. For example, Japanese Patent No. 5989357 discloses a technique in which the surfaces of the furnace wall and furnace floor of the accommodating unit are formed by a combination of members having different thermal emissivity so that the work receives a different amount of heat by radiant heat transfer from the furnace wall and the furnace floor, depending on the location in the accommodation space of the accommodating unit. Japanese Patent Laid-Open No. 2008-261619 discloses a technique in which a plurality of burners oriented in different directions is arranged inside the shuttle kiln and the interior of the furnace is uniformly stirred with combustion gas.

CITATION LIST

Patent Literature

[Patent Literature 1] Japanese Patent No. 5989357
[Patent Literature 2] Japanese Patent Laid-Open No. 2008-261619

SUMMARY OF THE INVENTION

Techniques for uniformizing the ambient temperature in the heating furnace have been proposed as described above but still leave room for improvement. For example, in the case where many works are placed on shelves installed in the heating furnace and concurrently subjected to heat treatment, the problem still arises that some space inevitably has a temperature lower than the set temperature in the heating furnace. To ensure quality, it is necessary to use only a region with a good temperature distribution avoiding such a space in which a work cannot be placed. In this case, the heating furnace has a restricted space for accommodating works and thus exhibits lower production efficiency.

An object of the present invention, which has been made in the above-described circumstances, is to provide, in one embodiment, a heating furnace that contributes to an improvement in the uniformity of the temperature in the furnace by a method different from a conventional one.

The inventor found that since the heat loss due to the radiation effect is significant near the exhaust port in the heating furnace, it is effective to provide a heat insulator, which includes a ceramic pillar-shaped honeycomb structure, between the exhaust port and the accommodation space in the furnace body accommodating the works, in solving the above-mentioned problem. The present invention, which has been completed according to the above-mentioned findings, will be illustrated below.

[1] A heating furnace comprising:

a furnace body;

an accommodation space in the furnace body, the accommodation space accommodating a work;

an exhaust port; and a heat insulator provided between the accommodation space and the exhaust port, the heat insulator including a pillar-shaped honeycomb structure including ceramic partition walls sectioning a plurality of cells extending from one bottom to another bottom.

[2] The heating furnace according to [1], wherein the porosity of the partition wall of the pillar-shaped honeycomb structure is greater than or equal to 13%.

[3] The heating furnace according to [1] or [2], wherein the thermal conductivity of the pillar-shaped honeycomb structure at 20° C. is less than or equal to 300 W/(m·K).

[4] The heating furnace according to any one of [1] to [3], wherein a softening point of the pillar-shaped honeycomb structure is greater than or equal to 1200° C.

[5] The heating furnace according to any one of [1] to [4], wherein an angle between a direction of gravity and a direction in which at least part of the plurality of cells included in the pillar-shaped honeycomb structure extends is 0° to 30°.

[6] The heating furnace according to [5], wherein an apparent aperture ratio of the pillar-shaped honeycomb structure is less than or equal to 94%.

[7] The heating furnace according to any one of [1] to [4], wherein an angle between a direction of gravity and a direction in which at least part of the plurality of cells included in the pillar-shaped honeycomb structure extends is 60° to 90°.

[8] The heating furnace according to any one of [1] to [7], wherein a kiln tool having vertically arranged one or more shelf boards on which a work is to be placed is installed in the accommodation space, and the exhaust port is provided below a lowermost shelf board.

[9] The heating furnace according to [8], wherein the lowermost shelf board includes the heat insulator.

[10] The heating furnace according to [9], wherein when an arbitrary cross section of the heat insulator, constituting the lowermost shelf board, parallel to a placement surface of the lowermost shelf board is vertically projected onto the placement surface, a proportion of an overlapping area between a projected figure of the cross section and the placement surface to an area of the placement surface of the lowermost shelf board is greater than or equal to 40%.

[11] The heating furnace according to [9] or [10], wherein the lowermost shelf board has a laminate structure in which the heat insulator is sandwiched between upper and lower support plates.

Advantageous Effects of Invention

In a heating furnace according to one embodiment of the present invention, the heat loss near the exhaust port due to the radiation effect can be suppressed. Hence, the temperature in the furnace is highly uniform and works can be accommodated in a wider space in the heating furnace. Accordingly, the heating furnace contributes to an improvement in the production efficiency of products manufactured through heat treatment.

BRIEF DESCRIPTION OF THE DRAWINGS

FIG. 1 is a schematic side view related to one embodiment of a heating furnace according to the present invention;

FIG. 2 is a perspective view showing a structural example of a heat insulator including a pillar-shaped honeycomb structure;

FIG. 3 is an explanatory diagram showing a measuring instrument for measuring a softening point;

FIG. 4 is a perspective view showing an example of a method for arranging heat insulators placed on a shelf board;

FIG. 5 is a perspective view showing another example of a method for arranging heat insulators placed on a shelf board;

FIG. 6 is a schematic side view of a heating furnace according to Comparative Example 1;

FIG. 7 is a schematic side view of a heating furnace according to Comparative Example 2; and FIG. 8 is a schematic side view of a heating furnace according to Comparative Example 3.

DETAILED DESCRIPTION OF THE INVENTION

Embodiments of the present invention will now be described in detail with reference to the accompanying drawings. It should be understood that the present invention should not be limited to the following embodiments, and appropriate design modifications, improvements, and the like based on knowledge common to those skilled in the art can be added without departing from the spirit of the present invention.

(1. Heating Furnace)

FIG. 1 is a schematic side view related to one embodiment of a heating furnace 100 according to the present invention. The heating furnace 100 includes a furnace body 102, an accommodation space 106 provided in the furnace body 102 for accommodating works (objects to be heated) 104, an exhaust port 108, a heat insulator 110 provided between the accommodation space 106 and the exhaust port 108.

Examples of works, which may be any type of objects, include electronic components, such as ferrite and ceramic capacitors, semiconductor products, ceramic products, potteries, oxide-based refractories, glass products, metal products, and carbon-based refractories such as alumina-graphite refractories and magnesia-graphite refractories.

In the accommodation space 106 in the heating furnace 100, a kiln tool 120 having vertically arranged one or more shelf boards 122 on which works 104 are to be placed can be installed. With the use of a plurality of shelf boards 122, the works can be vertically arranged in the accommodation space 106, thereby allowing the accommodation space 106 to be effectively used. It is preferable that the kiln tool 120 be composed of a refractory material, for example, an alumina and silicon carbide-based ceramic material.

Any heating method, for example, a combustion heating method in which fuel is burned or an electric heating method which uses electricity may be used in the furnace body 102. The embodiment shown in FIG. 1 employs a combustion heating method in which fuel is burned using a burner 107. To achieve highly efficient combustion, the burner 107 is preferably a regenerative burner. Any number of burners may be used and the number of burners may be set as appropriate according to the size or length of the furnace body 102.

The heating furnace 100, which may be of any type, may be a continuous furnace, such as a shuttle kiln, a tunnel kiln, a roller hearth kiln, or a pusher kiln, or a single furnace (batch furnace), such as a box kiln, a cowbell kiln, or an elevator kiln. In view of the ambient conditions, an atmosphere heating furnace or a reduction heating furnace may also be used. A reduction heating furnace refers to a heating furnace in which combustion is performed in a state where the m value (the ratio of the actual combustion air amount to the theoretical air amount) is less than 1.0. Heating may be performed for any purpose, for example, firing, degreasing, or drying.

The heating furnace 100 according to the embodiment shown in FIG. 1 is a shuttle kiln in which a kiln tool 120 is installed on a carriage 124. The carriage 124 is configured to be movable closer/further to the viewer referring to the drawing, between the interior of the furnace body 102 and the exterior of the furnace body 102. The works 104 are subjected to heat treatment while the carriage 124 is contained in the furnace body 102.

Exhaust gas generated in the heating furnace 100 (in this embodiment, combustion gas generated by the burner) passes through an exhaust hole 125 provided in the carriage 124, travels from an exhaust port 108 through a flue 130, and then is discharged. Since the temperature of the flue 130 is generally lower than that in the furnace, the heat loss due to radiation is significant near the exhaust port 108. The inventor has studied various measures to effectively suppress heat loss and found that it is effective to provide a ceramic heat insulator 110, which has a predetermined structure illustrated in FIG. 2, between the accommodation space 106 and the exhaust port 108. Specifically, the inventor found that it is effective to use a heat insulator 110 including a pillar-shaped honeycomb structure including ceramic partition walls 118 sectioning a plurality of cells 116 extending from one bottom 112 to the other bottom 114.

For example, as shown in FIG. 1, in the case where the exhaust port 108 is on the underside of the heating furnace 100, conventionally, it would be impossible to place the works 104 near the exhaust port 108 where a low temperature distribution appears, and a dead space is therefore left. For this reason, a space near the exhaust port 108, which is indicated by the dotted line, would conventionally not be an appropriate space to place the works 104 shown in FIG. 1. However, providing the above-described heat insulator 110 between the accommodation space 106, which accommodates the works 104, and the exhaust port 108 suppresses a temperature drop near the exhaust port 108, making it possible to place the works 104 in such a space. In other words, the space that can be used for heat treatment performed on the works in the heating furnace is expanded, so that the production efficiency can be increased. The present invention should not be limited by any theory but the pillar-shaped honeycomb structure is anisotropic in terms of convection, radiation, and heat transfer depending on the direction in which the cells extend, and positive utilization of such characteristics provides comprehensively high insulation effects. To be specific, a heat insulator having a pillar-shaped honeycomb structure allows convection to be suppressed by intentionally blocking air flows depending on the installation direction (the direction in which the cells extend). Further, since a heat insulator having a pillar-shaped honeycomb structure includes less heat transfer paths, high heat transfer suppression effects can be obtained regardless of the installation direction (the direction in which the cells extend). Furthermore, a heat insulator having a pillar-shaped honeycomb structure is expected to produce the effect of suppressing radiation in the direction in which radiation should be intentionally blocked depending on the installation direction (the direction in which the cells extend). In particular, in the case where the exhaust port 108 is on the underside of the heating furnace 100, when the heat insulator 110 is installed so that the cells extend in the horizontal direction, a series of multiple layers of partition walls sectioning a plurality of cells can effectively suppress radiation. A pillar-shaped honeycomb structure having a ceramic pillar-shaped structure is superior to a fibrous heat insulator in strength, lifetime, and handleability. For example, a fibrous heat insulator is easily deformable, while a ceramic pillar-shaped structure has high strength and shape retention. Besides, a fibrous heat insulator causes dust particles which may adhere to works and make them defective or deteriorate the working environments, while no such concerns arise for a ceramic pillar-shaped structure. A ceramic pillar-shaped structure is also superior in workability.

In the embodiment shown in FIG. 1, the position of the exhaust port 108 is located on the underside of the heating furnace 100 and the exhaust port 108 is formed below the lowermost shelf board; however, the exhaust port 108 may be located in any position. The exhaust port 108 may be installed on the topside of the heating furnace 100 or on a side wall of the heating furnace 100. It should be understood that, regardless of the position of the exhaust port 108, an intended heat insulating effect is obtained by providing the ceramic heat insulator 110 having a predetermined structure between the exhaust port 108 and the accommodation space 106 which accommodates the works 104.

(2. Heat Insulator)

The outer shape of the pillar-shaped honeycomb structure constituting the heat insulator 110 may be any shape as long as it is pillar-shaped, for example, a pillar shape with a circular bottom (a cylindrical pillar-shaped shape), a pillar shape with an oval-shaped bottom, or a pillar shape with a polygonal (e.g., triangle, quadrangle, pentagon, hexagon, heptagon, or octagon) bottom. Since a typical shelf board has a rectangular bottom, it is preferable that the pillar-shaped honeycomb structure have a rectangular bottom to facilitate arrangement on shelf boards.

Examples of the material for the heat insulator 110 include, but not be limited to, ceramic materials, such as cordierite, mullite, zircon, aluminum titanate, silicon carbide, silicon nitride, zirconia, spinel, indialite, sapphirin, corundum, and titania. It is preferable to use, among these, one or more materials selected from the group consisting of cordierite, mullite, aluminum titanate, silicon carbide, and silicon nitride, which have strength and heat resistance sufficient to bare repeated use. The ceramic material here may contain a ceramic component other than those described above.

The thermal conductivity of the pillar-shaped honeycomb structure constituting the heat insulator 110 is preferably low in order to increase heat insulation performance. To be specific, the thermal conductivity at 20° C. is preferably less than or equal to 300 W/(m·K), more preferably less than or equal to 200 W/(m·K), further more preferably less than or equal to 100 W/(m·K), further more preferably less than or equal to 60 W/(m·K). Although no lower limit is set for the thermal conductivity of the pillar-shaped honeycomb structure, the thermal conductivity at 20° C. is generally greater than or equal to 0.05 W/(m·K) and typically greater than or equal to 3 W/(m·K). In the present invention, the value of the thermal conductivity of the pillar-shaped honeycomb structure is a value measure by the laser flash method (JIS R1611-2010).

The partition wall 118 of the pillar-shaped honeycomb structure is preferably porous to make it less heat transferable. The higher the porosity of the partition wall 118, the lower the heat transferability and thermal conductivity. For this reason, the porosity is preferably greater than or equal to 13%, more preferably greater than or equal to 23%, further more preferably greater than or equal to 40%. From the viewpoint of ensuring the strength of the pillar-shaped honeycomb structure, the porosity of the partition wall 118 is preferably less than or equal to 72%, more preferably less than or equal to 69%, further more preferably less than or equal to 55%. In the present invention, the porosity of the partition wall 118 is measured using a mercury porosimeter by the mercury intrusion method conforming to JIS R1655: 2003.

The pillar-shaped honeycomb structure constituting the heat insulator 110 is installed in the heating furnace and therefore desirably has excellent heat resistance. To be specific, the softening point of the pillar-shaped honeycomb structure is preferably greater than or equal to 1200° C., more preferably greater than or equal to 1300° C., further more preferably greater than or equal to 1360° C. Although no upper limit is set for the softening point of the pillar-shaped honeycomb structure, such a softening point is generally less than or equal to 1430° C. and typically less than or equal to 1360° C.

In the present invention, the softening point of the pillar-shaped honeycomb structure is measured in the following manner. A test piece 204 which is a quadrangular prism having a 6.4-mm square bottom and a height (the length along the direction in which the cells extend) of 50 mm is cut out from the honeycomb structure. Next, as shown in FIG. 3, this test piece 204 is mounted on a measuring tool 200 and a weight (a 50-g balance weight) 202 is placed thereon to impose a load. Subsequently, with the load imposed on the test piece 204, heating to 1500° C. is performed at a temperature increase rate of 7.5° C./min. The dimensions of the test piece 204 in this state is measured at every increment of 1.25° C. to draw a dimensional contraction curve. From the obtained dimensional contraction curve, the temperature at which the contraction rate of the test piece 204 first reaches greater than or equal to 1.3% is determined. This temperature is referred to as "softening point".

There is no limitation on the direction of the axis of the pillar-shaped honeycomb structure (the direction in which the cells extend), which constitutes the heat insulator 110, disposed in the heating furnace 100; however, some embodiments preferred in terms of a relationship between the direction in which the cells extend and the direction of gravity can be given as examples.

When the direction in which a plurality of cells included in the pillar-shaped honeycomb structure extends is generally parallel to the direction of gravity, the heat insulator 110 is highly effective in blocking radiation in a direction perpendicular to the direction of gravity and therefore this configuration can be particularly preferably used for installation of the exhaust port 108 on a side surface of the heating furnace 100. In addition, when the direction in which a plurality of cells included in the pillar-shaped honeycomb structure extends is generally parallel to the direction of gravity, the heat insulator 110 exhibits high contraction strength against the direction of gravity and is therefore advantageous for, for example, placing articles such as works on the heat insulator 110. For this reason, it is possible that, for example, the exhaust port 108 is installed on the underside of the heating furnace 100 and the heat insulator 110 constitutes a part of the lowermost shelf board 122.

Accordingly, in one embodiment of heating furnace according to the present invention, the angle between the direction of gravity and the direction in which at least part of a plurality of cells included in the pillar-shaped honeycomb structure extends, preferably the direction in which all the cells extend is in the range of 0° to 30°. This angle is preferably in the range of 0 to 15°, more preferably in the range of 0 to 5°, most preferably 0°.

When the direction in which a plurality of cells included in the pillar-shaped honeycomb structure extends is generally parallel to the direction of gravity in this manner, the apparent aperture ratio of the pillar-shaped honeycomb structure is preferably made low to suppress radiation passing through each cell in the direction of gravity. Making the apparent aperture ratio low is especially effective when the exhaust port 108 is installed on the underside of the heating furnace 100. To be specific, the apparent aperture ratio of the pillar-shaped honeycomb structure is preferably less than or equal to 94%, more preferably less than or equal to 87%, further more preferably less than or equal to 81%. It should be noted that, because the heat insulating effect produced by heat transfer suppression becomes weak when the apparent aperture ratio of the pillar-shaped honeycomb structure is too low, the apparent aperture ratio of the pillar-shaped honeycomb structure is preferably greater than or equal to 59%, more preferably greater than or equal to 65%, further more preferably greater than or equal to 69%.

In the present invention, the apparent aperture ratio of the pillar-shaped honeycomb structure is defined as a ratio of the total area of the opening portions of the cells at two end faces (both bottoms) perpendicular to the direction in which the cells in the pillar-shaped honeycomb structure extend, to the total area of the two end faces (both bottoms). The porosity of the pillar-shaped honeycomb structure is not taken into consideration. For example, when the pillar-shaped honeycomb structure is a cylindrical column, the area of each bottom thereof is $A_1$, the aperture area in which each cell is opened at each bottom is $A_2$, and the number of cells is n, the apparent aperture ratio is $(n\times2\times A_2)/(2\times A_1)\times100(\%)$.

For each cell, it is preferable that one end or both ends with respect to the direction in which the cells extend be sealed to block the radiation path. Cells in the pillar-shaped honeycomb structure may be plugged by adopting any method which is well-known. The apparent aperture ratio in the state where cells are plugged is calculated assuming that the cells are opened without being plugged.

When the direction in which a plurality of cells included in the pillar-shaped honeycomb structure extends is generally perpendicular to the direction of gravity, the heat insulator 110 produces a high effect of blocking radiation in the direction of gravity, so that this configuration can be particularly preferably used when the exhaust port 108 is installed on the underside or topside of the heating furnace 100. It should be noted even when the direction in which a plurality of cells included in the pillar-shaped honeycomb structure extends is generally perpendicular to the direction of gravity, works, shelf boards, or other articles can be placed on the heat insulator 110: for example, the exhaust port 108 may be installed on the underside of the heating furnace 100 and the heat insulator 110 may be configured to serve as part of the lowermost shelf board 122.

Accordingly, in one embodiment of heating furnace according to the present invention, the angle between the direction of gravity and the direction in which at least part of a plurality of cells included in the pillar-shaped honeycomb structure extends, preferably the direction in which all the cells extend is in the range of 60° to 90°. This angle is preferably in the range of 75 to 90°, more preferably in the range of 85 to 90°, most preferably 90°.

In the case where the heat insulator 110 constitutes part of the lowermost shelf board 122, from the viewpoint of increasing the heat insulating effect, it is desirable to provide one or more heat insulators 110, which constitute the lowermost shelf board 122, so that, when an arbitrary cross section parallel to the placement surface 126 of the lowermost shelf board 122 is vertically projected onto the placement surface 126, the proportion of the overlapping area between the projected figure of the cross section and the placement surface 126 to the area of the placement surface 126 of the lowermost shelf board 122 is greater than or equal to 40%, preferably greater than or equal to 45%, more preferably greater than or equal to 50%. Here, the area of the projected figure is determined assuming that the honeycomb structure constituting the heat insulator is solid and ignoring the presence of pores and cells. Further, when a plurality of heat insulators is provided, the area of the projected figure refers to the total area of the projected figure at the cross section of all the heat insulators along the same plane parallel to the placement surface of the lowermost shelf board. It should be noted that a placement surface refers to a surface on which works are placed.

FIG. 4 is a schematic view showing an exemplary structure of the lowermost shelf board 122. In the embodiment shown in FIG. 4, the shelf board 122 has a laminate structure in which a plurality of heat insulators 110 is sandwiched between upper and lower support plates 122*a* and 122*b*. The heat insulators 110 are only required to be placed on the lower support plate 122*b* and the upper support plate 122*a* is only required to be placed on the heat insulators 110, which enables easy installation. The support plates 122*a* and 122*b* may be composed of the same material as the above-mentioned material for shelf boards. In this embodiment, each heat insulator 110 is a quadrangular prism, and the direction in which a plurality of cells included in the pillar-shaped honeycomb structure constituting the heat insulator 110 extends is parallel to the direction of gravity. In this embodiment, heat insulators of the same material and in the same shape are arranged on the support plate 122*b* in a matrix of 5×8=40. In FIG. 4, when the area of the placement surface 126 is $A_1$ and an arbitrary cross section parallel to the placement surface 126 for one heat insulator 110 is $A_2$, a ratio of the overlapping area described above to the area of the placement surface 126 of the lowermost shelf board 122 is $(40\times A_2)/A_1\times100(\%)$.

FIG. 5 is a schematic view showing another exemplary structure of the lowermost shelf board 122. In the embodiment shown in FIG. 5, a shelf board 122 has a laminate structure in which heat insulators 110 are sandwiched between upper and lower support plates 122*a* and 122*b*. The heat insulators 110 are only required to be placed on the lower support plate 122*b* and the upper support plate 122*a* is only required to be placed on the heat insulators 110, which enables easy installation. The support plates 122*a* and 122*b* may be composed of the same material as the above-mentioned material for shelf boards. In this embodiment, the heat insulator 110 is a quadrangular prism, and the direction in which a plurality of cells included in the pillar-shaped honeycomb structure constituting the heat insulator 110 extends is perpendicular to the direction of gravity. In this embodiment, heat insulators of the same material and in the same shape are arranged on the support plate 122*b* in a matrix of 5×2=10. In FIG. 5, when the area of the placement surface 126 is $A_1$ and an arbitrary cross section parallel to the placement surface 126 for one heat insulator 110 is $A_2$, a ratio of the overlapping area described above to the area of the placement surface 126 of the lowermost shelf board 122 is $(10\times A_2)/A_1\times 100(\%)$.

In either of the embodiments shown in FIG. 4 and FIG. 5, the distance between the upper and lower support plates 122*a* and 122*b* (the thickness of the heat insulator 110) may be set as appropriate according to the structure, material, and other conditions of the heat insulator and can be set to, for example, 10 to 210 mm, typically 15 to 50 mm.

The cell density of the pillar-shaped honeycomb structure at a cross section perpendicular to the direction in which the cells 116 extend (a cross section parallel to the bottom face) is preferably 15 to 200 cells/cm$^2$, further preferably 30 to 150 cells/cm$^2$. Setting the cell density in these ranges is preferable from the viewpoint of increasing the heat insulating effect. A cell density is a value obtained by dividing the number of cells existing at one bottom of the pillar-shaped honeycomb structure by the area of that bottom.

The cell cross section perpendicular to the direction in which the cell 116 extends may be in any shape, for example, a triangle, a square, a hexagon, an octagon, or a combination thereof. When the pillar-shaped honeycomb structure is put in a sideways position (so that the direction in which the cells extend is perpendicular to the direction of gravity), quadrangular cells, which exhibit high strength, are preferably used assuming the cell density is the same.

The thickness of the partition wall 118 is preferably greater than or equal to 50 μm, more preferably greater than or equal to 75 μm from the viewpoint of increasing the strength of the honeycomb structure. Meanwhile, the thickness of the partition wall is preferably less than or equal to 420 μm, more preferably less than or equal to 320 μm from the viewpoint of enhancing the heat insulating effect.

(3. Method of Manufacturing Heat Insulator)

The pillar-shaped honeycomb structure constituting the heat insulator 110 may be manufactured, by way of non-limiting example, by using the following procedure.

(1) A raw material composition containing a ceramic raw material, a dispersion medium, a pore former, and a binder is kneaded to prepare clay, and the clay is extruded to be formed into a desired pillar-shaped honeycomb formed body. The raw material composition may contain a dispersant or other additives as needed. Extrusion molding can use a die for defining a desired overall shape, cell shape, partition wall thickness, cell density, and the like.

(2) The honeycomb formed body is dried, and then is subjected to degreasing and firing, thereby manufacturing a ceramic pillar-shaped honeycomb structure. For the conditions of the drying step, the degreasing step, and the firing step, known conditions may be adopted according to the material composition constituting the honeycomb formed body.

A ceramic raw material is a raw material for a portion remaining after firing of metal oxide, metal, and the like, and constituting the frame of the honeycomb structure as a ceramic. The ceramic raw material can be provided in the form of, for example, powder. Examples of the ceramic raw material include various raw materials for obtaining ceramics, such as cordierite, mullite, zircon, aluminum titanate, silicon carbide, silicon nitride, zirconia, spinel, indialite, sapphirin, corundum, and titania. Specific examples include, but not be limited to, silica, talc, alumina, aluminum hydroxide, kaolin, serpentine, pyrophyllite, brucite, boehmite, mullite, and magnesite. One kind of ceramic raw material may be used alone or two or more kinds of ceramic raw materials may be used in combination.

Examples of the pore former, which may be any material as long as it forms pores after firing, include wheat flour, starch, foamed resin, water absorbent resin, silica gel, carbon (e.g. graphite), ceramic balloon, polyethylene, polystyrene, polypropylene, nylon, polyester, acrylic, phenol, expanded foamed resin, and unexpanded foamed resin. One kind of pore former may be used alone or two or more kinds of pore formers may be used in combination. The content of the pore former may be set as appropriate considering the porosity and strength of the honeycomb structure, and may be set so that the porosity of the honeycomb structure falls within the range of 13 to 72%. In the case where an organic pore former is used, its content can be adjusted, for example, within the range of 0 to 20 parts by mass relative to 100 parts by mass of ceramic raw material.

Examples of the binder include organic binders, such as methyl cellulose, hydroxypropoxyl cellulose, hydroxyethyl cellulose, carboxymethyl cellulose, and polyvinyl alcohol. Use of methyl cellulose and hydroxypropoxyl cellulose in combination is particularly preferred. One kind of binder may be used alone or two or more kinds of binders may be used in combination. The content of the binder may be set as appropriate considering the strength of the honeycomb formed body. For example, the content of the binder can be set within the range of 1 to 10 parts by mass relative to 100 parts by mass of ceramic raw material.

The dispersant may be a surfactant, such as ethylene glycol, dextrin, fatty acid soap, or polyalcohol. One kind of dispersant may be used alone or two or more kinds of dispersants may be used in combination. The content of the dispersant may be set as appropriate considering the dispersibility, orientation during extrusion molding, wettability, and the like. For example, the content of the dispersant can be set within the range of 0 to 5 parts by mass relative to 100 parts by mass of ceramic raw material.

Examples of the dispersion medium include water and a mixed solvent of water and alcohol or other organic solvents, and water, in particular, may be preferably used. The content of the dispersion medium may be set as appropriate considering the formability and strength. For example, the content of the dispersion medium can be set within the range of 30 to 150 parts by mass relative to 100 parts by mass of ceramic raw material. In this description, the value of the content of the dispersion medium in the honeycomb formed body is measured by the loss on drying method.

The drying step may use, for example, known drying methods, such as hot-air drying, microwave drying, dielectric drying, pressure reducing drying, vacuum drying, or freezing drying. In particular, a drying method is preferred in which hot-air drying, microwave drying, or dielectric drying is used in combination, from the viewpoint of drying the entire formed body rapidly and uniformly. In the case where a plugged portion is formed, the plugged portion is formed on both bottoms of the dried honeycomb formed body and is dried, thereby yielding a honeycomb dried body.

In the degreasing step, the binder, the pore former, and other organic matters are removed by combustion. The combustion temperature of the binder is about 200° C., and the combustion temperature of the pore former is about 300 to 1000° C. Accordingly, in the degreasing step, the honeycomb formed body may be heated to the range of about 200 to 1000° C. The heating time, which may be usually set to, but not limited to, about 10 to 100 hours. The honeycomb formed body that has been subjected to the degreasing step is referred to as a calcined body.

The firing step can be accomplished by, for example, heating the calcined body to 1350 to 1600° C. and holding it for three to ten hours, depending on the material composition of the honeycomb formed body.

EXAMPLES

Examples will be given below for better understanding of the present invention and its advantages. However, the present invention should not be limited to Examples.

Example 1

(1. Manufacturing of Heat Insulator)

Talc (40 parts by mass), aluminum oxide (15 parts by mass), aluminum hydroxide (15 parts by mass), kaolin (15 parts by mass), and crystal silica (15 parts by mass) were mixed to prepare a cordierite-forming raw material. Subsequently, methyl cellulose (5 parts by mass) serving as a binder, carbon (5 parts by mass) serving as a pore former, potassium laurate soap (one part by mass) serving as a dispersant, and water (45 parts by mass) serving as a dispersion medium were added to the obtained cordierite-forming raw material, and they were introduced into a mixing machine and mixed for three minutes, thereby preparing a wet mixture.

The obtained wet mixture was introduced into a screw type extrusion kneader, and then was kneaded to fabricate a cuboid of clay. This clay was introduced into an extrusion molding machine to be subjected to extrusion molding, thereby providing a honeycomb formed body in a cuboid shape. The obtained honeycomb formed body was subjected to dielectric drying and hot-air drying, and both bottoms thereof were then cut to obtain predetermined dimensions, thereby providing a honeycomb dried body.

Next, the honeycomb dried body was heated under the atmosphere at 200° C. for 20 hours for degreasing, and then was subjected to firing at 1430° C. for 10 hours, thereby providing a honeycomb structure (heat insulator) which was a 70 mm (length)×70 mm (width)×280 mm (height (length in the direction in which the cells extend)) cuboid. A plurality of honeycomb structures manufactured under the same conditions was cut into a plurality of short honeycomb structures. Each honeycomb structure had the following specifications.

Outer shape: 70 mm (length)×70 mm (width)×35 mm (height (length in the direction in which the cells extend)) cuboid Cell shape at the cross section perpendicular to the direction in which the cells extend: square Cell density (the number of cells per unit cross section): 31 cells/cm$^2$ Partition wall thickness: 305 μm Thermal conductivity at 20° C.: 4.0 W/(M·K)

Partition wall porosity: 52%

Softening point: 1400° C.

Apparent aperture ratio: 69%

Plugging portion: none (2. Fabrication of Kiln Tool)

A kiln tool was prepared which includes vertically arranged multiple (here, six) silicon nitride-bonded SiC (SINSIC) shelf boards (400 mm (length)×600 mm (width)×10 mm (thickness)) shown in FIG. 1. Note that only the lowermost shelf board had the following configuration. As shown in FIG. 4, the obtained multiple heat insulators was vertically sandwiched between silicon nitride-bonded SiC (SINSIC) support plates (400 mm (length)×600 mm (width)×10 mm (thickness)) so that the direction in which the cells extend is parallel to the direction of gravity, that is, the angle between the direction in which the cells extend and the direction of gravity is 0°, thereby fabricating the lowermost shelf board (A distance between the upper and lower support plates was 35 mm). As shown in FIG. 4, multiple heat insulators were placed on the lower support plate in a 5 by 8 matrix (total of 40 pieces). In this case, for the heat insulators constituting the lowermost shelf board, when an arbitrary cross section parallel to the placement surface of the lowermost shelf board was vertically projected onto the placement surface, the proportion of the overlapping area between the projected figure of the cross section and the placement surface to the area of the placement surface of the lowermost shelf board was 82% according to calculation.

(3. Experiment with Heating Furnace)

The prepared kiln tool was placed on a carriage and introduced into a shuttle kiln, and the interior of the furnace was heated with a burner with a set temperature of 1430° C. Upon attainment of the steady state, the temperature distribution on the placement surfaces of the lowermost shelf board and the shelf board one level higher than the lowermost shelf board was determined using a common thermal history sensor (product name: Referthermo from Japan Fine Ceramics Center (JFCC)), and the temperatures of the portions at the maximum temperature and the minimum temperature were investigated using a thermocouple. The results showed that the difference between the maximum temperature and the minimum temperature was 15° C. for the lowermost shelf board, and 11° C. for the shelf board one level higher than the lowermost shelf board. In addition, investigation showed that a temperature difference in the central portion of the placement surface was 2° C. between the lowermost shelf board and the shelf board one level higher than the lowermost shelf board.

Example 2

(1. Manufacturing of Heat Insulator)

Multiple honeycomb structures (heat insulators) which were 70 mm (length)×70 mm (width)×280 mm (height (length in the direction in which the cells extend)) cuboids were prepared in the same manner as in Example 1. Subsequently, each honeycomb structure was cut into half, thereby preparing ten flat cuboids having dimensions of 70 mm (length)×35 mm (width)×280 mm (height (length in the direction in which the cells extend)).

(2. Fabrication of Kiln Tool)

A kiln tool was prepared which includes vertically arranged multiple (here, six) silicon nitride-bonded SiC (SINSIC) shelf boards (400 mm (length)×600 mm (width)×10 mm (thickness)) shown in FIG. 1. Note that only the lowermost shelf board had the following configuration. As shown in FIG. 5, the obtained multiple heat insulators was vertically sandwiched between silicon nitride-bonded SiC (SINSIC) support plates (400 mm (length)×600 mm (width)×10 mm (thickness)) so that the direction in which the cells extend is perpendicular to the direction of gravity, that is, the angle between the direction in which the cells extend and the direction of gravity is 90°, thereby fabricating the lowermost shelf board (A distance between the upper and lower support plates was 35 mm). As shown in FIG. 5, multiple heat insulators were placed in a 5 by 2 matrix (=10 pieces). In this case, when an arbitrary cross section of each heat insulator constituting the lowermost shelf board parallel to the placement surface of the lowermost shelf board was vertically projected onto the placement surface, the proportion of the overlapping area between the projected figure of the cross section and the placement surface to the area of the placement surface of the lowermost shelf board was 82% according to calculation.

(3. Experiment with Heating Furnace)

The prepared kiln tool was placed on a carriage and introduced into a shuttle kiln, and the interior of the furnace was heated with a burner with a set temperature of 1430° C. Upon attainment of the steady state, for the placement surfaces of the lowermost shelf board and the shelf board one level higher than the lowermost shelf board, the temperature distribution was determined and the maximum temperature and the minimum temperature were investigated in the same manner as in Example 1. The results showed that the difference between the maximum temperature and the minimum temperature was 12° C. for the lowermost shelf board, and 10° C. for the shelf board one level higher than the lowermost shelf board. In addition, investigation showed that a temperature difference in the central portion of the placement surface was 1° C. between the lowermost shelf board and the shelf board one level higher than the lowermost shelf board.

Example 3

Manufacturing of heat insulators, fabrication of a kiln tool, and experiment with a heating furnace were performed using the same method and conditions as in Example 2 except that the dimensions of the cuboid of each honeycomb structure were changed to 70 mm (length)×70 mm (width)×280 mm (height (length in the direction in which the cells extend). In this case, the distance between the upper and lower support plates was 70 mm. The results showed that the difference between the maximum temperature and the minimum temperature was 10° C. for the lowermost shelf board, and 9° C. for the shelf board one level higher than the lowermost shelf board. In addition, investigation showed that a temperature difference in the central portion of the placement surface was 0° C. (no difference was found) between the lowermost shelf board and the shelf board one level higher than the lowermost shelf board.

Example 4

Manufacturing of heat insulators, fabrication of a kiln tool, and experiment with a heating furnace were performed using the same method and conditions as in Example 2 except that the apparent aperture ratio of each honeycomb structure was changed to 63%, the porosity of the partition wall was changed to 40%, and the thermal conductivity at 20° C. was changed to 20.0 W/(M·K). The results showed that the difference between the maximum temperature and the minimum temperature was 18° C. for the lowermost shelf board, and 11° C. for the shelf board one level higher than the lowermost shelf board. In addition, investigation showed that a temperature difference in the central portion of the placement surface was 3° C. between the lowermost shelf board and the shelf board one level higher than the lowermost shelf board.

Comparative Example 1

As shown in FIG. 6, a kiln tool was prepared which had the same shelf board structure as in Example 1 except that the lowermost shelf board was changed to a silicon nitride-bonded SiC (SINSIC) shelf board (400 mm (length)×600 mm (width)×10 mm (thickness)). The kiln tool was placed on a carriage and introduced into a shuttle kiln, and the interior of the furnace was heated with a burner with a set temperature of 1430° C. Upon attainment of the steady state, for the placement surfaces of the lowermost shelf board and the shelf board one level higher than the lowermost shelf board, the temperature distribution was determined and the maximum temperature and the minimum temperature were investigated in the same manner as in Example 1. The results showed that the difference between the maximum temperature and the minimum temperature was 31° C. for the lowermost shelf board, and 13° C. for the shelf board one level higher than the lowermost shelf board. In addition, investigation showed that a temperature difference in the central portion of the placement surface was 10° C. between the lowermost shelf board and the shelf board one level higher than the lowermost shelf board.

Comparative Example 2

As shown in FIG. 7, a kiln tool was prepared which had the same shelf board structure as in Example 1 except that the lowermost shelf board was changed to a stack of two silicon nitride-bonded SiC (SINSIC) shelf boards (each having dimensions of 400 mm (length)×600 mm (width)×10 mm (thickness)). The kiln tool was placed on a carriage and introduced into a shuttle kiln, and the interior of the furnace was heated with a burner with a set temperature of 1430° C. Upon attainment of the steady state, for the placement surfaces of the lowermost shelf board and the shelf board one level higher than the lowermost shelf board, the temperature distribution was determined and the maximum temperature and the minimum temperature were investigated in the same manner as in Example 1. The results showed that the difference between the maximum temperature and the minimum temperature was 30° C. for the lowermost shelf board, and 12° C. for the shelf board one level higher than the lowermost shelf board. In addition, investigation showed that a temperature difference in the central portion of the placement surface was 10° C. between the lowermost shelf board and the shelf board one level higher than the lowermost shelf board.

Comparative Example 3

The lowermost shelf board had the following configuration. An alumina spacer (50 mm (length)×50 mm (width)×35 mm (thickness)) was placed at the four corners of a silicon nitride-bonded SiC (SINSIC) shelf board (400 mm (length)×600 mm (width)×10 mm (thickness)) and a silicon nitride-bonded SiC (SINSIC) shelf board (400 mm (length)×600 mm (width)×10 mm (thickness)) was placed thereon, thereby fabricating the lowermost shelf board. A kiln tool having the same shelf board structure as in Example 1 except for the lowermost shelf board was prepared. The kiln tool was placed on a carriage and introduced into a shuttle kiln, and the interior of the furnace was heated with a burner with a set temperature of 1430° C. Upon attainment of the steady state, for the placement surfaces of the lowermost shelf board and the shelf board one level higher than the lowermost shelf board, the temperature distribution was determined and the maximum temperature and the minimum temperature were investigated in the same manner as in Example 1. The results showed that the difference between the maximum temperature and the minimum temperature was 26° C. for the lowermost shelf board, and 12° C. for the shelf board one level higher than the lowermost shelf board. In addition, investigation showed that a temperature difference in the central portion of the placement surface was 8° C. between the lowermost shelf board and the shelf board one level higher than the lowermost shelf board.

REFERENCE SIGNS LIST

100 Heating furnace
102 Furnace body
104 Work
106 Accommodation space
107 Burner
108 Exhaust port
110 Heat insulator
112 One bottom
114 The other bottom
116 Cell
118 Partition wall
120 Kiln tool
122 Shelf board
124 Carriage
125 Exhaust hole
126 Placement surface
130 Flue
122*a*, 122*b* Support plate
200 Measuring tool
202 Weight
204 Test piece

The invention claimed is:

1. A heating furnace comprising:

a furnace body;

an accommodation space in the furnace body, the accommodation space is adapted for accommodating a work;

an exhaust port comprising an opening in the furnace body; and a heat insulator provided between the accommodation space and the opening of the exhaust port, the heat insulator including a pillar-shaped honeycomb structure including ceramic partition walls sectioning a plurality of cells extending from one bottom to another bottom, wherein a kiln tool having vertically arranged one or ore shelf boards on which a work is to be placed is installed in the accommodation space, and the exhaust port is provided below a lowermost shelf board.

2. The heating furnace according to claim 1, wherein the porosity of the partition wall of the pillar-shaped honeycomb structure is greater than or equal to 13%.

3. The heating furnace according to claim 1, wherein the thermal conductivity of the pillar-shaped honeycomb structure at 20° C. is less than or equal to 300 W/(m K).

4. The heating furnace according to claim 1, wherein a softening point of the pillar-shaped honeycomb structure is greater than or equal to 1200° C.

5. The heating furnace according to claim 1, wherein an angle between a direction of gravity and a direction in which at least part of the plurality of cells included in the pillar-shaped honeycomb structure extends is 0° to 30°.

6. The heating furnace according to claim 5, wherein an apparent aperture ratio of the pillar-shaped honeycomb structure is less than or equal to 94%.

7. The heating furnace according to claim 1, wherein an angle between a direction of gravity and a direction in which at least part of the plurality of cells included in the pillar-shaped honeycomb structure extends is 60° to 90°.

8. The heating furnace according to claim 1, wherein the lowermost shelf board includes the heat insulator.

9. The heating furnace according to claim 8, wherein when an arbitrary cross section of the heat insulator, constituting the lowermost shelf board, parallel to a placement surface of the lowermost shelf board is vertically projected onto the placement surface, a proportion of an overlapping area between a projected figure of the cross section and the placement surface to an area of the placement surface of the lowermost shelf board is greater than or equal to 40%.

10. The heating furnace according to claim 8, wherein the lowermost shelf board has a laminate structure in which the heat insulator is sandwiched between upper and lower support plates.

* * * * *